United States Patent [19]

Johnson et al.

[11] Patent Number: 4,516,088

[45] Date of Patent: May 7, 1985

[54] POWER ABSORBING TERMINATION FOR A WAVEGUIDE TRANSMISSION LINE

[76] Inventors: Ray M. Johnson, 6355 Scarlett Ct., Dublin, Calif. 94566; George H. Dremann, 1940 Hopkins, Berkeley, Calif. 94707

[21] Appl. No.: 325,675

[22] Filed: Nov. 30, 1981

[51] Int. Cl.[3] ..... H01P 1/26

[52] U.S. Cl. ..... 333/22 F; 333/248

[58] Field of Search ..... 333/22 F, 22 R

[56] References Cited

U.S. PATENT DOCUMENTS

| | | | |
|---|---|---|---|
| 2,881,399 | 4/1959 | Leyton | 333/22 F |
| 3,040,252 | 6/1962 | Novak | 333/22 F X |
| 3,147,451 | 9/1964 | Merdinian | 333/22 F |
| 3,241,089 | 3/1966 | Treen . | |
| 3,597,708 | 8/1971 | Perreault . | |
| 3,624,566 | 11/1971 | Perreault | 333/22 F X |
| 3,634,784 | 1/1972 | Lesyk et al. | 333/22 F |

*Primary Examiner*—Paul Gensler

*Attorney, Agent, or Firm*—Bruce & McCoy

[57] ABSTRACT

A power absorbing termination for a waveguide transmission line comprised of a waveguide section containing a fluid carrying dielectric taper which is inclined relative to the waveguide axis so that the point end of the taper lies against the guidewall of the waveguide section. Fluid in the dielectric taper is preferably circulated around a center planar divider extended down the taper's axis; alternatively, fluid is circulated through the taper by inducing a spiral flow of fluid in the taper hollow.

17 Claims, 5 Drawing Figures

POWER ABSORBING TERMINATION FOR A WAVEGUIDE TRANSMISSION LINE

BACKGROUND OF THE INVENTION

The present invention relates to microwave devices generally and more specifically to matched impedance waveguide termination devices used for absorbing high microwave power propagated down a waveguide transmission line.

In high power microwave applications it is often necessary to terminate a transmission line with a substantially matched load capable of absorbing and dissipating the power transmitted into the load. Methods of terminating a waveguide transmission line have been developed involving solid materials as the power absorbing medium, however, in most cases the absorbing medium is water. Where water is used the general class of termination devices is generically referred to as "water loads".

An object in designing a water load is usually to produce a load with high power handling capability, low power reflection (i.e. low VSWR characteristics), relative broadband frequency operation, and relative simplicity of manufacture. These objectives should be achieved for applications involving high pulse and average power, typically pulse power levels in the range of megawatts to tens of megawatts or higher over the bandwidth desired, and average power levels as high as kilowatts to hundreds of kilowatts over the bandwidth desired.

It is also desirable for certain applications to provide a water load which maintains its performance for all orientations of the guide and for modest changes in fluid temperature or in the temperature of the surrounding environment. This means that the fluid flow characteristics should be maintained and entrapment of air bubbles prevented for all guide orientations; otherwise there will be a deleterious effect upon the amount of power reflected by the termination. In conventional water loads, maintaining uniform flow characteristics, as well as providing for an initially low reflected power, is a particular problem which the present invention seeks to overcome.

Conventionally, water loads have been constructed with a fluid carrying dielectric plug which is tapered or bullet shaped and which is positioned to extend down the center of the waveguide where the point of the plug receives the incident power in a region of high electric field. The mismatch at the end of the plug in this high electric field region causes undesirable reflections. One attempted solution to the mismatch problem has been to simply move the fluid carrying plug off center relative to the center axis of the guide. For example, a rectangular waveguide water load has been constructed having a straight sided plug with a pencil point end where the plug is placed against one of the sidewalls of the guide away from the highest on-axis E field concentrations. While some improvement in the mismatch characteristics of the load has been achieved by placing the dielectric plug off center in this manner, the physical dimensions of the plug have always presented enough of an abrupt physical transistion to the E fields in the transmission line to cause undesirable reflections.

It is an object of the present invention to reduce reflected power relative to conventional loads. It is noted that the accepted measure of reflective power in a waveguide is given by the voltage standing wave ratio, commonly denoted VSWR. The present invention seeks to provide a water load having a VSWR value less than 1.2 for the operating frequency range of the load. This corresponds to reflective power levels of less than 0.83 percent. It is also the object of this invention to provide lower VSWR values, less than 1.05, within certain narrow frequency operating ranges.

It is intended that the present invention be particularly suitable for use in connection with applications where the orientation of the power transmission system varies with time as dictated by the system's application. An example of such a system would be medical accelerators of the type rotated about a patient in both a vertical and horizontal plane.

The present invention is also intended to provide a high peak and average power absorbing termination which is mechanically small, and easy to construct and assemble.

SUMMARY OF THE INVENTION

The present invention is a power absorbing termination for a waveguide transmission line comprised of a section of waveguide having a power receiving end adapted to mate with the waveguide transmission line to be terminated, and a base end opposite the power receiving end. A dielectric taper extends into the waveguide section from the base end thereof such that the point end of the dielectric taper points toward the waveguide's power receiving end; the taper is additionally inclined with respect to the axis of the waveguide such that the point end of the dielectric taper lies substantially against the guidewall so as to be laterally displaced to a region of very low electric field. The dielectric taper is provided with fluid circulating passage means for circulating fluids throughout the taper from the taper's base to its point end. It is intended that the fluid circulation will provide for a substantially complete sweeping of the inside of the taper and for a substantial elimination of air bubbles within the taper. Finally, fluid inlet and outlet means communicate with the fluid passage means in the taper for conveying fluids into and out of the waveguide taper.

In the illustrated embodiments of the inventions two separate fluid circulating schemes are described. In the preferred scheme, a planar divider extends substantially the length of the taper and is truncated to leave a passage at the point end of the taper around which fluid can flow. The divider lengthwise divides the taper into first and second adjacent fluid passages communicating, respectively, with the termination's fluid inlet and fluid outlet means. This central planar divider will cause fluids to sweep the taper over its entire length, and will preferably be fabricated of metal for strength and for superior heat dissipation characteristics. It will be understood that in accordance with the invention the planar divider can be used in any dielectric taper whether having an inclined position or otherwise positioned in the waveguide.

In the second described embodiment of the fluid circulating means fluid is injected into a taper in a tangential stream so as to induce a spiral fluid motion within the taper as the fluid flows to the taper's point end. Return flow of the fluid occurs substantially along the axis of the taper and out through the axially aligned fluid outlet means.

DETAILED DESCRIPTION OF PREFERRED EMBODIMENT

Figure 1:
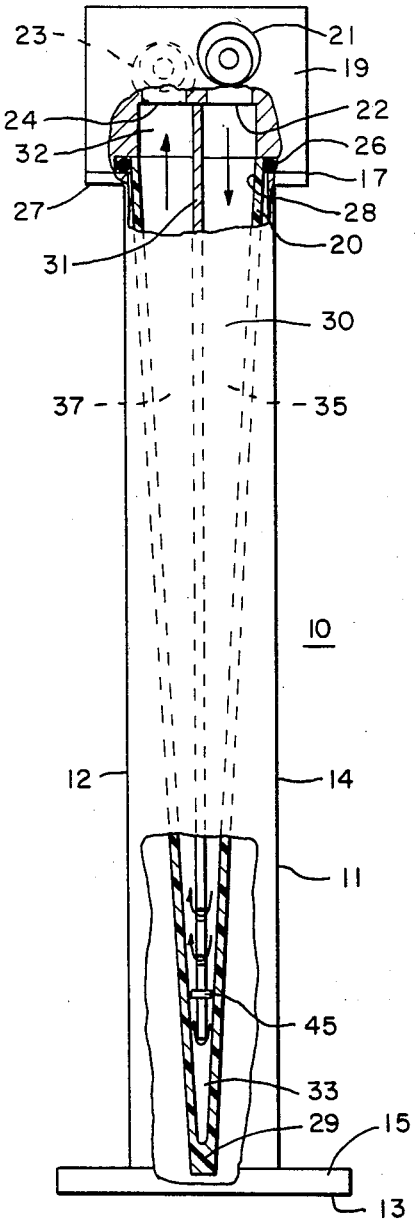
FIG. 1 is a side elevational view, partly in cross-section, of one embodiment of the power absorbing termination of the present invention.
Figure 3:
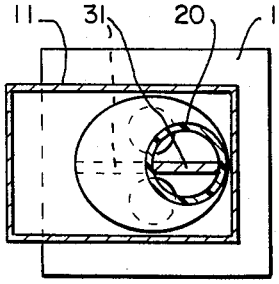
FIG. 3 is a cross-sectional view of the power absorbing termination shown in FIG. 2 taken along lines 3—3.
Figure 2:
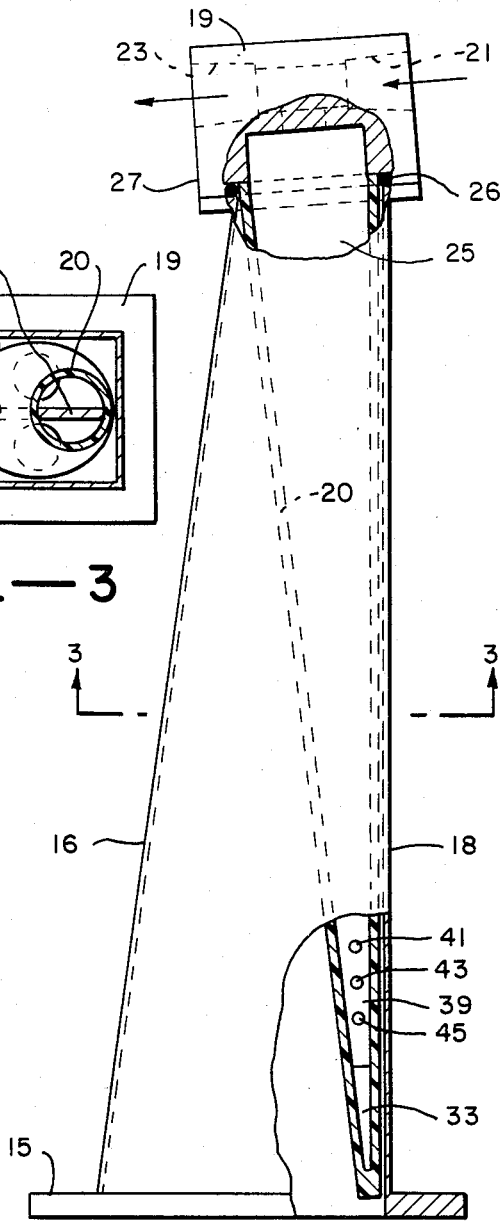
FIG. 2 is a top plan view of the power absorbing termination shown in FIG. 1.

Referring now to the drawings, FIGS. 1–3 show a power absorbing termination, generally denoted by the number 10, comprised of a straight section of waveguide 11 defined by a power receiving end 13, to which there is secured waveguide flange 15 used to attach the termination to a waveguide transmission line (not shown), broadwalls 12, 14, and sidewalls 16, 18. Attached to the base end 17 of the waveguide section 11 and forming the base end of the termination, is a boss 19 having fluid inlet and outlet means in the form of a fluid inlet passage 21 and a fluid outlet passage 23 which communicate through inlet port 22 and outlet port 24 with the interior of a dielectric taper 25 which in turn extends lengthwise down the waveguides section 11. Preferably, the dielectric taper will be a thin walled, hollow, cone which extends from the boss 19 to the power receiving end 13 of the termination where the point end 29 of the dielectric cone will face into the power incident to the termination. Importantly, the taper's shape is characterized by the fact that its cross-sectional dimension decreases substantially uniformly from its base to its point end to permit the taper to be inclined as hereinafter described. The taper's base end 28 is seen to have a maximum dimension slightly greater than the height of the waveguide so that the taper can be wedged into place in the waveguide's base end 17 and sealed to the boss and waveguide by O-ring 26.

As is most clearly shown in FIG. 2, the dielectric taper 25 is inclined with respect to the axis of the waveguide such that the point end 29 of the taper lies against the waveguide sidewall 18. Thusly inclined, it can be seen that the point end of the taper is laterally displaced into a region of very low electric field for the fundamental waveguide mode. The fundamental waveguide mode for the rectangular waveguide illustrated in the drawings is the TE10 rectangular mode which has only one component of electric field represented by an electric field vector extending between the broadwalls of the guide. The field vector of the TE10 mode diminishes to zero at the side walls from a maximum field strength at the center of guide. The point end 19 of the dielectric taper, due to the taper's inclined position relative to the guide axis, is therefore positioned to avoid abrupt transitions as seen by the electric field. It has been found that this inclination of the taper significantly decreases the pertubation in the electric field of the incident microwave power and results in a good broadband match for the waveguide termination.

The dielectric taper 25 is provided with fluid circulating passage means for passing fluids, typically water, from the fluid input means into the base end 28 of the taper, from there to the taper's point end 29, back to the base end, and out the fluid outlet means. By sweeping the interior of the hollow taper with a power absorbing fluid the microwave energy is dissipated within the taper in the form of heat, and as herein described this power dissipation will, in the present invention, be achieved with a minimum amount of reflective power.

To achieve fluid circulation through the dielectric taper, the preferred embodiment shown in FIGS. 1–3 contemplates a planar divider 31 which is shaped to fit closely into the interior hollow contour of the dielectric taper 25 and extending into boss cavity 32; the divider is of a length whereby it will extend nearly the length of the taper, save for a small end cavity area 33 at the taper's point end. Inserted within the taper as shown, the planar divider 31 lengthwise divides the hollow 30 of the taper into first and second adjacent and connected fluid passages 35, 37 which communicate, respectively, with the fluid inlet passage 21 and the fluid outlet passage 23.

The arrows in FIG. 1 illustrate the manner in which fluid will sweep the entire taper interior, with the divider being long enough to force the fluid to the cavity area 33 at the extreme end of the taper. To reduce the pressure necessary for an adequate volume flow of fluid, the divider's point end 39 is drilled with holes 41, 43; it is also found that the flow characteristics at the point end of the taper, that is through the end cavity area 33, can be improved by providing a small protuberance 45 on either side of divider's point end 39. It is believed that this protuberance reduces turbulence and cavitation in this region, a phenomenon which can lead to entrapment of air bubbles, which in turn can create mismatches that reflect power.

It is noted that the planar divider 31 within the conical taper 25 must be capable of supporting the resultant force caused by differential fluid pressures on opposite sides of the divider, a differential which is principally produced by a pressure drop through the constructed portions of the taper passages. A metal divider is preferable in this regard. It is noted from the drawings that a metal divider would preferably be oriented parallel to the plane of the waveguide broad walls 12, 14 such that the electric field vectors of the fundamental waveguide mode, i.e. the TE10 rectangular mode, are perpendicular to the metal surface of the divider. With such an orientation the divider will have an insignificant effect on the modal field patterns and therefore will not produce any appreciable power reflection. Though the above described orientation of the metal divider 31 is the preferred orientation, it is found that the metal divider can be oriented in any direction with respect to the TE10 electric field without a substantial deleterious effect.

In addition to forcing fluids to completely sweep the cone, and in addition to efficiently eliminating trapped air bubbles in the cone, the use of a metal planar divider 31 also acts as a good conductor for transferring heat from the fluid and for conducting heat to the boss 19 at the base end of the waveguide section. The boss, preferably metal, also serves as a fluid cooled heat sink.

Figure 4:
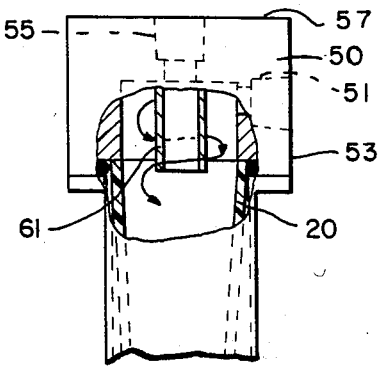
FIG. 4 is a partial side elevational view, in partial cross-section, of a power absorbing termination in accordance with the invention, showing an alternative embodiment of the fluid circulating means for the device's dielectric taper.
Figure 5:
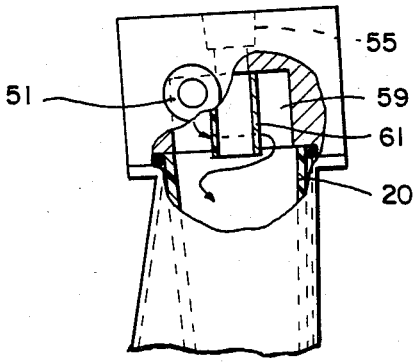
FIG. 5 is a partial top plan view, in partial cross-section, of the power absorbing termination shown in FIG. 4.

FIGS. 4 and 5 show an alternative embodiment of the fluid circulating passage means for the taper 25. This embodiment includes an inlet fluid passage 51 extending inwardly from one side of the boss 50 and a separate fluid outlet passage 55 extending inwardly from the base 57 of the boss 50 in axial alignment with the taper 25. The fluid inlet passage 51, which is offset relative to the axis of the fluid outlet passage, injects a tangential flow of fluid into a fluid receiving chamber 59 which surrounds a tubular extension 61 of the fluid outlet passage 55. The fluid thusly injected into the fluid receiving chamber circulates in a spiral motion to the point end of the taper. Fluid return from there occurs along the taper axis, with the fluid exiting through the fluid outlet passage 55 and its extension 61. With this alternative fluid injection system, the circulated fluid will effectively sweep the entire volume of the taper if the taper is oriented horizontally or with its point end down. It is believed, however, that, if the point end of the taper is oriented in a vertically upward position, air entrapment at the point end of the taper may occur and significantly increase the otherwise low VSWR values. Thus, the fluid circulation design illustrated in FIGS. 4 and 5 are primarily intended for applications where the orientation of the power absorbing termination can be controlled.

As best illustrated in FIG. 2, the waveguide section 11 is preferably tapered from its power receiving end 13 to its base end 17 by tapering the guide's broadwalls 12, 14. By tapering the waveguide in reverse relation to the internal dielectric taper through which the power absorbing fluid is circulated, the cross-sectional area of the taper will substantially match the cross-sectional area of the waveguide in a shorter distance: therefore, the guide can be made shorter. It should be noted that a shortened termination can also be achieved by the use of two dielectric tapers side by side within an untapered guide, however, the resulting reduction in length will be obtained at the expense of and increased number of parts and plumbing.

It is noted that a cone shaped taper having a linearly increasing diameter from its point end 29 to its base end 28 is preferred, however, it is contemplated that the dielectric taper could as well have other shapes or non-linear taper so long as the taper can be properly inclined to place the taper's point end substantially against the sidewall. The preferred circular cross-section will better support the hoop stresses resulting from expected internal fluid pressures of 90 PSIG or more. Moldable, high pressure, low loss plastic, such as polypropylene or Teflon, can suitably serve as the taper material.

Therefore, it can be seen that the present invention provides a power absorbing termination which has relatively low VSWR characteristics over the termination's operating bandwidth, and which will operate efficiently in any orientation and under conditions of changing orientation such as may be encountered in certain applications. The termination has been described above in terms of its preferred embodiment, with the understanding that the above description of the preferred embodiment is not intended to limit the scope of the invention to any described detail, except insofar as it is required by the appended claims.

We claim:

1. A power absorbing termination for a waveguide transmission line comprising a section of waveguide having guidewalls, a power receiving end adapted to mate with said waveguide transmission line, and a base end opposite said power receiving end, a dielectric taper, defined by a base and point end, extending through said waveguide section from the base end thereof and being inclined relative to the axis of said waveguide such that the point end of said dielectric taper lies substantially against the guidewall of said waveguide section, said dielectric taper having fluid circulating passage means therein for circulating fluids through said taper from the base end to the point end thereof, said waveguide section tapering from its power receiving end to its base end such that the cross-sectional area of the base end of the waveguide section decreases with the increased cross-sectional area of said dielectric taper, and fluid inlet and fluid outlet means communicating with the fluid passage means of said taper.

2. The power absorbing termination of claim 1 wherein the cross-sectional area of the waveguide section at the base end thereof is approximately equal to the cross-sectional area of the base end of said dielectric taper.

3. The power absorbing termination of claim 1 wherein said taper is hollow and the fluid passage means therein is formed by a planar divider extending down the axis of the taper hollow to lengthwise divide said hollow into first and second adjacent fluid passages communicating, respectively, with said fluid inlet and outlet means, said divider having a truncated point end to permit fluid to flow between said first and second adjacent fluid passages at the point end of said taper.

4. The power absorbing termination of claim 3 wherein said planar divider is fabricated of metal.

5. The power absorbing termination of claim 3 wherein said divider is fabricated of a dielectric material.

6. The power absorbing termination of claim 4 wherein said planar divider is disposed in an axial plane which is perpendicular to the electric fields for the fundamental mode for said waveguide section.

7. The power absorbing termination of claim 3 wherein at least one hole is formed in the truncated end of said planar divider for increasing the flow of liquid through the point end of said taper.

8. The power absorbing termination of claim 7 wherein a protuberance extends outwardly from at least one side of the truncated end of said divider.

9. The power absorbing termination of claim 2 wherein said fluid inlet means is disposed to direct a tangential flow of fluid into the base of said dielectric conical taper, and said fluid outlet means is substantially axially aligned with the base of said taper to receive an axial flow of fluid directed toward said outlet means.

10. A power absorbing termination for a waveguide transmission line comprising a section of rectangular waveguide having, side walls, broadwalls, a power receiving end adapted to mate with said waveguide transmission line, and a base end opposite said power receiving end, a conical dielectric taper extending from the base end of said waveguide section, said conical taper being inclined toward one of the sidewalls of said rectangular waveguide section whereby the point end of said taper lies substantially against one of the sidewalls of said waveguide section, said conical taper being hollow and having a metal planar divider extending down the axis of the taper hollow to lengthwise divide said taper hollow into first and second adjacent fluid passages, and said planar divider having a truncated point end to permit fluid to flow between said first and second adjacent fluid passages at the point end of said divider, and fluid inlet and outlet means communicating, respectively, with said first and second fluid passages formed by said planar divider whereby fluid will sweep substantially the entire hollow of said dielectric taper by circulating around said divider.

11. The power absorbing termination of claim 10 wherein the truncated end of said divider has two holes therethrough and a protuberance thereon.

12. A power absorbing termination for a waveguide transmission line comprising a section of waveguide having guidewalls, a power receiving end adapted to mate with said waveguide transmission line, and a base end opposite said power receiving end, a dielectric taper, defined by a base and point end, extending through said waveguide section from the base end thereof, said dielectric taper having fluid circulating passage means therein for circulating fluids through said taper from the base end to the point end thereof, and back again to the base end, fluid inlet and fluid outlet means located at the base end of said section of waveguide, said taper being hollow and the fluid passage means therein being formed by a planar divider extending down the axis of the taper hollow to lengthwise divide said hollow into first and second adjacent fluid passages communicating, respectively, with said fluid inlet and outlet means, said divider having a truncated point end to permit fluid to flow between said first and second adjacent fluid passages at the point end of said taper whereby said fluid tends to sweep said point end.

13. The power absorbing termination of claim 12 wherein said planar divider is fabricated of metal.

14. The power absorbing termination of claim 12 wherein said divider is fabricated of a dielectric material.

15. The power absorbing termination of claim 13 wherein said planar divider is disposed in an axial plane which is perpendicular to the electric fields for the fundamental mode for said waveguide section.

16. The power absorbing termination of claim 12 wherein at least one hole is formed in the truncated end of said planar divider for increasing the flow of liquid through the point end of said taper.

17. The power absorbing termination of claim 16 wherein a protuberance extends outwardly from at least one side of the truncated end of said divider.

* * * * *